US008356927B1

(12) United States Patent
Lordi et al.

(10) Patent No.: US 8,356,927 B1
(45) Date of Patent: Jan. 22, 2013

(54) UNIVERSAL HAND MIXER

(75) Inventors: Angioletto Lordi, Gillette, NJ (US); Christopher Zailo, Millington, NJ (US); Christopher Miller, Bronxville, NY (US); Paul Dowd, Scarsdale, NY (US); Robert Victor, Sunnyside, NY (US); Norm Barrigas, Danbury, CT (US)

(73) Assignees: Angioletto Lordi, Gillette, NJ (US); Christopher M. Zailo, Millington, NJ (US)

( * ) Notice: Subject to any disclaimer, the term of this patent is extended or adjusted under 35 U.S.C. 154(b) by 0 days.

(21) Appl. No.: 13/272,444

(22) Filed: Oct. 13, 2011

(51) Int. Cl.
*B01F 5/06* (2006.01)

(52) U.S. Cl. ..... 366/130; 366/176.3; 366/189

(58) Field of Classification Search ..... 366/129, 366/130, 162.3, 176.3, 189, 192; 222/246
See application file for complete search history.

(56) References Cited

U.S. PATENT DOCUMENTS

| | | | | | |
|---|---|---|---|---|---|
| 1,929,616 | A | | 10/1933 | Vopata | |
| 2,193,322 | A | | 3/1940 | Lozier et al. | |
| 2,370,759 | A | * | 3/1945 | Thompson | 366/150.1 |
| 3,164,303 | A | | 1/1965 | Trautmann | |
| 3,217,946 | A | | 11/1965 | Cook | |
| 3,281,123 | A | * | 10/1966 | Dailey | 366/162.3 |
| 3,347,410 | A | | 10/1967 | Schwartzman | |
| 3,380,451 | A | | 4/1968 | Porter et al. | |
| 3,546,129 | A | * | 12/1970 | Youngdahl et al. | 366/176.3 |
| 3,946,732 | A | | 3/1976 | Hurschman | |
| 4,371,094 | A | | 2/1983 | Hutter | |
| 4,479,781 | A | * | 10/1984 | Herold et al. | 433/90 |
| 4,671,263 | A | * | 6/1987 | Draenert | 606/94 |
| 4,776,704 | A | * | 10/1988 | Kopunek et al. | 366/184 |
| 5,015,101 | A | * | 5/1991 | Draenert | 366/349 |
| 5,114,411 | A | | 5/1992 | Haber | |
| 5,137,514 | A | * | 8/1992 | Ryan | 604/99.01 |
| 5,259,537 | A | * | 11/1993 | Beers et al. | 222/246 |
| 5,372,586 | A | * | 12/1994 | Haber et al. | 604/89 |
| 5,551,778 | A | | 9/1996 | Hauke et al. | |
| 6,871,996 | B2 | | 3/2005 | Jonsson | |
| 7,018,089 | B2 | * | 3/2006 | Wenz et al. | 366/130 |
| 7,243,660 | B2 | | 7/2007 | Capristo | |
| 7,744,270 | B2 | * | 6/2010 | Plishka et al. | 366/189 |
| 8,021,037 | B2 | * | 9/2011 | Krueger et al. | 366/189 |

OTHER PUBLICATIONS

U.S. Appl. No. 61/399,843, filed Jul. 19, 2010, Lordi, Angioletti, et al.

* cited by examiner

*Primary Examiner* — David Sorkin
*Assistant Examiner* — Fazle A Rashid
(74) *Attorney, Agent, or Firm* — Gearhart Law, LLC

(57) ABSTRACT

A universal mixer for mixing two or more components is provided. The mixer comprises two telescopically nested cylinders, the inner cylinder having a piston that stays in place due to hydraulic pressure inside the cylinders. The components to be mixed are inserted into a space formed by the outer cylinder, a cap and a gasket having one or more holes. The user forces the compounds through the holes by holding the handles of the mixer and pushing a back handle forward thereby causing the inner cylinder to move forward. The inner cylinder preferably has a diameter that narrows slightly from its back to front end. Further mixing is achieved by pulling the back handle backwards whereby the components are squeezed between the piston and the gasket and the components move through the holes in the gasket into the container formed by the outer cylinder.

13 Claims, 7 Drawing Sheets

UNIVERSAL HAND MIXER

FIELD OF THE INVENTION

The invention relates to devices for mixing viscose liquid substances with each other. More specifically the invention relates to devices for mixing hair color.

BACKGROUND OF THE INVENTION

The invention relates to a device for mixing viscose liquid substance with each other. More specifically the invention relates to devices for mixing colors, such as hair color.

Hair colors regularly comprise two components that are mixed together just before applying the color on the hair. It is important that the components are mixed together just before use. Moreover, it is important to have correct amounts of the compounds and to mix them thoroughly.

An essential step in coloring hair is to mix the developer and the color agent together just before coloring the hair. Usually these components are very viscose and mixing may sometimes be difficult. However, for achieving a good result, it is essential to have the components well mixed and moreover it is important to mix the components relatively fast.

The current methods used by professionals to mix the components vary depending on the individual establishment. The most prevalent way is to separately measure the liquid developer in a scientific like measurement beaker, while simultaneously measuring the proper color component ratio (oz). Once in the same bowl the components are mixed with a spade or a fork like tool vigorously which may cause pain to the individual's wrists. This method may result in premature mixing, unnecessary wear and tear, and splashing of the dye which can be damaging to personal property with the strong chemicals that the components contain. This method is not preferred even if protective gloves are used because it causes the person mixing the dye to inhale the chemicals which may be toxic and cause allergies.

The instant invention provides a novel handheld mixer that efficiently mixes the components and allows easy application of the mixed color onto the hair.

There are several kinds of hand held mixers disclosed in the prior art, however none of the publications provide anything similar to this invention.

The relevant prior art involving devices to mix hair colors includes:

U.S. Pat. No. 7,972,056 discloses a countertop apparatus dispensing hair coloring, developers and bleach in specified quantities and mixing them, substantially reducing the manual labor involved in performing such tasks. Housing has an upstanding back wall and a bottom wall. A plurality of hair color tube stations is mounted on a forward side of the back wall and a hair color tube squeezing device is positioned at each hair color tube station. The hair color tube squeezing device includes a pair of confronting rollers that engage the trailing end of an inverted hair color tube. A plurality of developer reservoirs and a bleach hopper are also mounted to the apparatus. First and second mixing bowls receive and mix hair coloring and developer at first and second stations, and a third mixing bowl receives and mixes bleach and developer at a third station. Operation of the apparatus is keypad-controlled.

U.S. Pat. No. 7,243,660 discloses a hair coloring apparatus, kit, and related methods. The apparatus includes a container having a medial body portion and an inner container chamber formed in the medial body portion for containing a first hair coloring solution. The container also includes an interior recess for containing a second hair coloring solution and a plunger used for mixing the second hair coloring solution into the first hair coloring solution within the inner chamber. The apparatus also includes a recess closing means such as a valve to isolate the second hair coloring solution from the first hair coloring solution prior to mixing. The apparatus also includes a hair color mixture dispenser connected to the container. The dispenser includes a brush applicator having a plurality of clusters of flexible bristles for applying a hair coloring mixture onto the hair of a user.

There is also a variety of publications disclosing mixers that are not specifically meant for mixing hair dyes, but other liquid or pulverized components:

U.S. Pat. No. 6,871,996 discloses a device for mixing pulverulent and liquid substances with each other for the manufacture of medical products, wherein a displaceable piston means has at least one groove extending around said piston means and at least one sealing ring is located in said groove. At least one connecting passage is provided for preventing a liquid substance from generating or building up such a pressure in an inner space in the groove within or behind the sealing ring that said pressure presses the sealing ring in a direction outwards relative to the groove towards a surrounding wall of the mixing device and prevents or counteracts flow of the liquid substance past the piston means when said piston means is displaced.

U.S. Pat. No. 5,114,411 discloses vial having first and second chambers initially separated by a rupturable barrier. The first chamber is a variable volume chamber defined by a cylinder, the rupturable barrier at the second end of the cylinder and a piston. The second chamber is created by a telescoping container mounted to a second end of the cylinder. The chambers are telescopically collapsed causing fluid pressure in the second chamber to rupture the barrier so the components mix in the first chamber. The piston is driven through the cylinder from pre-mix to post-mix positions by the liquid from the second chamber. This dislodges a safety shield at the first end of the cylinder to expose the piston. The mixed contents of the first, variable volume chamber are removed by inserting a needle cannula through the now exposed piston; aspiration of the mixed contents take place without the introduction of air into the first chamber since the piston moves back down the cylinder as the contents are removed. A spike adapter can be used to transfer the contents of the vial to a conventional IV bag.

U.S. Pat. No. 4,371,094 discloses a dispensing cartridge for separately storing two materials until the time of use in two compartments divided by a barrier assembly. The elements that comprise the barrier assembly are used to divide the cartridge into two compartments, to mix the two materials, and to extrude the mixed material.

U.S. Pat. No. 3,946,732 discloses two-chamber syringes for mixing a powdered medicament with a diluent and then injecting the mixed ingredients into a patient, together with a technique for assembling those syringes. According to one aspect of the invention, the syringe includes a vial formed with a single glass cylinder closed at one end by a plunger and at its other end by a pierceable diaphragm. An intermediate pierceable diaphragm divides the cylinder into upper and lower chambers, and is locked against axial movement relative to the cylinder. A powdered medicament is provided in the upper chamber and a diluent is provided in the lower chamber. The ingredients are mixed by inserting the vial into a cup-shaped holder having a hollow, pointed needle extending from the base of the holder. Axial pressure on the vial causes the pointed end of the needle to sequentially pierce the end intermediate diaphragms, and to cause the diluent to flow into an opening in the sidewall of the needle, through the needle, and then into the upper chamber from the pointed needle end. The thus-mixed ingredients are dispensed by applying axial pressure to the plunger, or by drawing metered amounts into the medicament pressurizing chamber of a needleless, hypojet injector.

U.S. Pat. No. 3,347,410 provides an applicator for use with a container provided with a neck having an open end and having a first substance disposed therein, said applicator comprising a retainer ring having a projecting portion for reception in said neck, and a portion overlying said open end, said applicator further including a fitting detachably engaging the outer surface of said neck, and applicator head having openings therethrough, a resilient bellows integral with said applicator head and said fitting and connecting said fitting to said applicator head, said projecting portion being provided at the lowermost end thereof with sealing means to hold a second substance within said retainer ring, and a stem integrally depending from said applicator head and being engageable with said sealing means upon depression of said applicator head and bellows to open aid sealing means to permit the second substance to mix with the first substance, said bellows normally urging said stem away from said sealing means.

U.S. Pat. No. 3,217,946 discloses a dispensing cartridge having an elongated cylindrical shell of readily deformable material, a dispensing port at one end of the shell, removable means to seal the dispensing port prior to use of the cartridge, readily deformable end wall means to close the end of the shell opposite the dispensing port, said end wall means having a base portion of the general configuration of a hollow cylinder and an adjacent, convex portion integrally formed with the cylindrical base portion and providing closure of said last mentioned end of the shell, said cylindrical base portion being sized for close abutting juxtaposition with the inner surface of the shell, the convex side of said convex portion of the end wall means facing towards said dispensing port and seal means comprising an annular skirt extending towards said dispensing port and integrally formed with one of said portion an annular V-shape cavity with the open side of the cavity facing towards the dispensing port, said skirt effectuating liquid-tight seal with the inner surface of the shell.

U.S. Pat. No. 3,216,430 discloses a dual compartment container for separately storing two ingredients, subsequently intermixing them, and later dispensing the mixture comprising; an elongate cylindrical shell to contain the two ingredients and having a normally closed dispensing outlet at one of the ends, and end wall closing the other end of the shell and cooperating with the shell to form a container, a partition extending generally diametrically across the entire span of said shell at an intermediate point in the length of the latter to divide it into two compartments at opposing ends of said shell to store said to ingredients separately, said partition having a sealing edge in contact with the cylindrical inner walls of said shell around its periphery and having a central axially extending bore therethrough, a dasher extending across at least a major portion of the span of said shell and having an elongate handle passing freely through the bore in the partition and extending slidably through said end wall, the bore in said partition having a smooth annular wall in the end thereof confronting the dasher and having a thread formed in its remote end, and a central boss on said dasher surrounding said handle and confront aid partition and boss having an annular portion to engage the annular portion of said bore to completely seal said partition and having a threaded portion to engage the threaded portion of said bore to secure said partition and said dasher together in sealing relation for storage purposes.

U.S. Pat. No. 2,193,322 discloses a combination of a hypodermic syringe and multiple compartment ampule.

U.S. Pat. No. 1,929,616 discloses a container comprising a tubular cartridge hermetically sealing closure plugs at both ends of the cartridge, a separator made of yieldable material in the interior of the cartridge and frictionally held against the interior wall surface of the cartridge at a predetermined point and adapted to seal the cartridge spaces at both sides of said separator from each other, and tension means extending through one of said closure plugs for moving said separator from the predetermined point and for deforming it, whereby communication between said originally separated spaces in the container is established.

Accordingly, various implements are known in the art, but fail to address all of the problems solved by the invention described herein. One embodiment of this invention is illustrated in the accompanying drawings and will be described in more detail herein below.

SUMMARY OF THE INVENTION

Therefore, the present invention succeeds in conferring the following, and others not mentioned, desirable and useful benefits and objectives.

It is an object of the present invention to provide a hand held mixer that is easy to fill and easy to use.

It is another object of the present invention to provide a hand held mixer that allows thorough mixing of hair colors without spilling and spreading the dye around.

Yet another object of the present invention is to provide a hand held mixer that allows accurate measurement of the compounds to be mixed.

It is an object to this invention to provide a universal mixer comprising:

- an outer cylinder having a front end and a back end,
  - said front end being grooved to fit to a detachable cap having a valve, and
  - said back end being grooved to fit detachably to a retainer ring;
- an inner cylinder being telescopically nested into the outer cylinder;
  - said inner cylinder having a front end and a back end;
  - said front end being sealed with a gasket having one or more holes, and
  - said inner cylinder snugly fitting in the outer cylinder;
- a piston inserted inside the inner cylinder,
  - said piston comprising a head, a connecting rod and a knob,
    - said head snugly fitting into the inner cylinder,
    - said connecting rod connecting the head and the knob, and
    - the knob enabling moving the connecting rod inward and outward;
- a front handle comprising a handle-piece and a veil-piece,
  - said veil-piece surrounding the front end of the outer cylinder;
- a back handle comprising a handle-piece and a veil-piece,
  - said veil-piece surrounding the back end of the inner cylinder;
- the outer cylinder being capable of receiving components to be mixed together through the opened cap when the inner cylinder is pulled backwards by holding the front handle and pulling the back handle backwards;
- the mixer being capable of initially mixing the components when the cap is closed and a user is holding the front handle and pushing the back handle toward forward, whereby the components enter into the inner cylinder through the holes in the gasket while the inner cylinder moves forward inside the outer cylinder; and the mixer being capable of further mixing the components when the user holds the front handle and pulls the back handle backward, whereby the inner cylinder moves backward and the piston stays in place causing the components to squeeze between the gasket and the head of the piston and thereby enter through the holes in the gasket into the outer cylinder.

Another object of this invention is to provide a method to mix two or more components, said method comprising the steps of:

a) providing a mixer comprising an outer cylinder having a front end and a back end,
   said front end being grooved to fit to a detachable cap having a valve, and
   said back end being grooved to fit detachably to a retainer ring;
   an inner cylinder being telescopically nested into the outer cylinder;
   said inner cylinder having a front end and a back end;
   said front end being sealed with a gasket having one or more holes, and
   said inner cylinder snugly fitting in the outer cylinder;
   a piston inserted inside the inner cylinder,
   said piston comprising a head, a connecting rod and a knob,
   said head snugly fitting into the inner cylinder,
   said connecting rod connecting the head and the knob, and
   the knob enabling moving the connecting rod inward and outward;
   a front handle comprising a handle-piece and a veil-piece, said veil-piece surrounding the front end of the outer cylinder;
   a back handle comprising a handle-piece and a veil-piece, said veil-piece surrounding the back end of the inner cylinder;
b) opening the cap, pulling the inner cylinder backward by pulling the back handle backwards while holding the front handle, and pulling the piston out;
c) filling the components into a space formed by the outer cylinder and closing the cap and the valve;
d) forcing the components to move through the holes in the gasket into the inner cylinder by moving the inner cylinder forward by holding the front handle and pushing the back handle forward;
e) allowing further mixing of the components by forcing the components through the holes in the gasket into the outer cylinder by moving the inner cylinder backward by holding the front handle and pulling the back handle backwards;
f) repeating steps d and e) as many times as needed to get a complete mixing of the compounds and having step d) as the last step;
g) opening the valve and dispensing the completely mixed compounds through the valve by pushing the piston inside the inner cylinder.

DETAILED DESCRIPTION OF THE INVENTION

Figure 1:
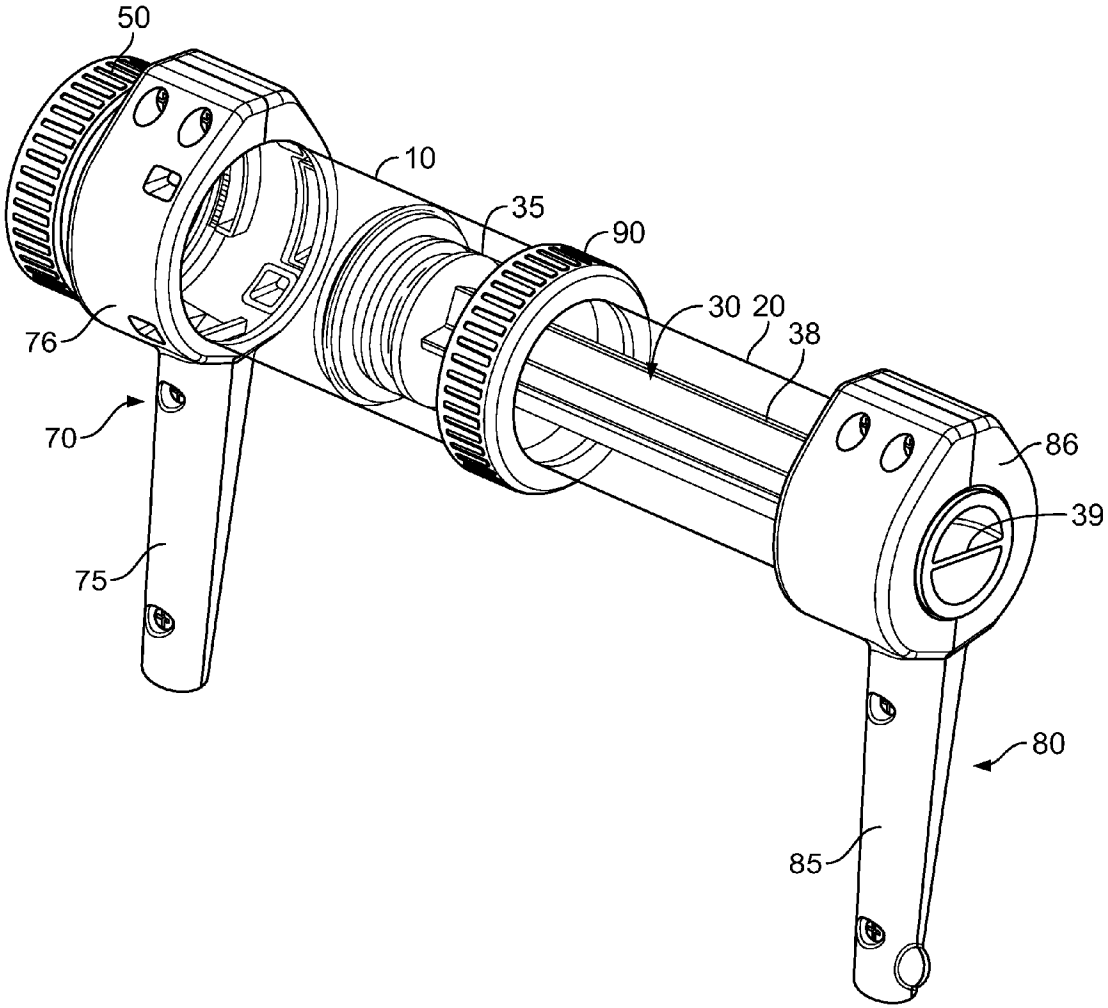
FIG. 1 shows a perspective view of a preferred embodiment of the invention.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Now referring to FIG. 1, a perspective view of the device is shown. The mixer comprises an outer cylinder (10), an inner cylinder (20), a piston (30) having a head (35), a connecting rod (38) and a knob (39), a cap (50), a front handle (70) having a handle portion (75) and a veil-portion (76), a back handle (80) having a handle portion (85) and a veil-portion (86).

Figure 2:
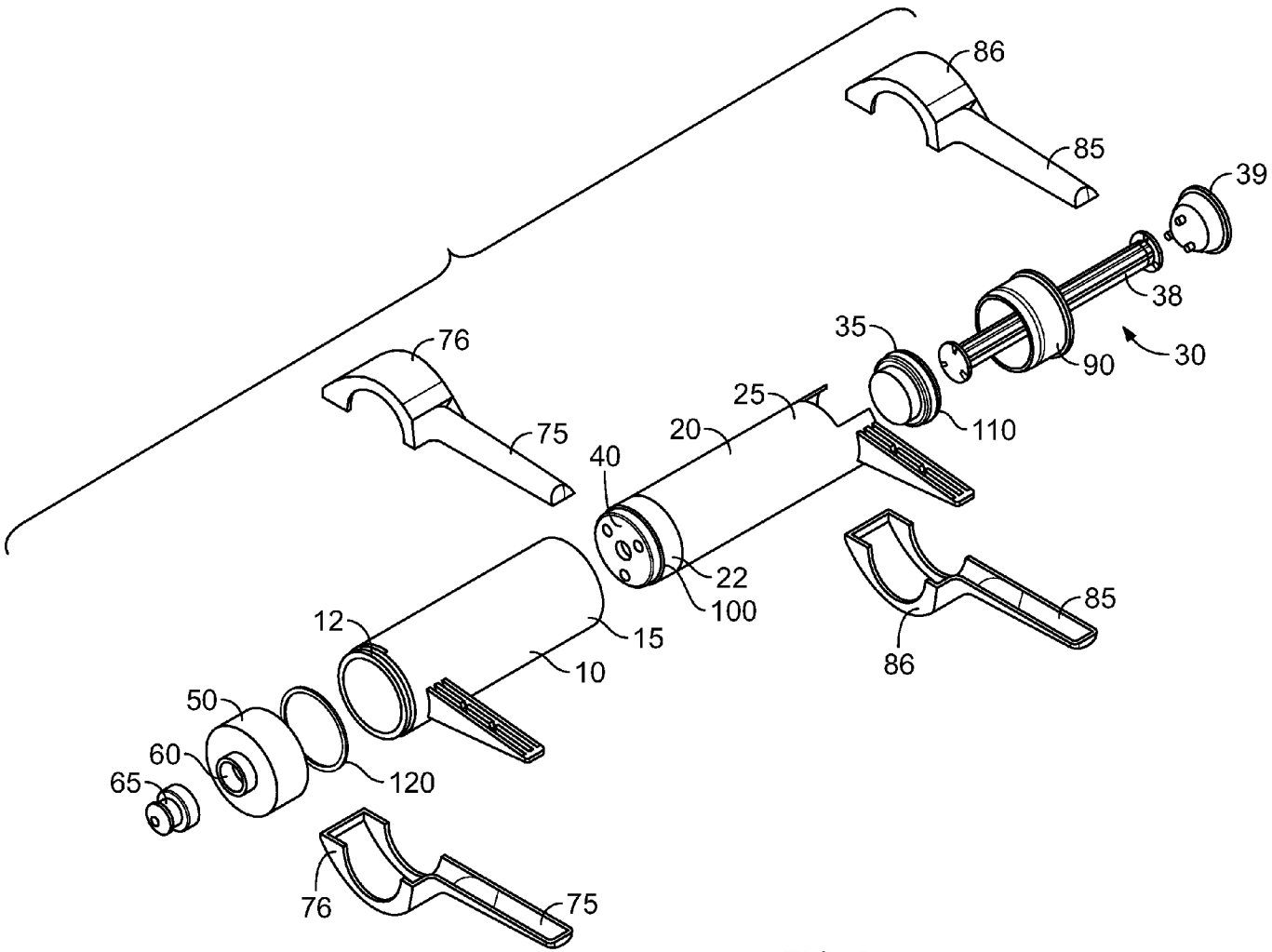
FIG. 2 shows an exploded view of the preferred embodiment of present invention illustrating various component parts.

Referring now to FIG. 2 an exploded view of the mixer is shown. The figure shows an outer cylinder (10) having a grooved front end (12) and a back end (15); an inner cylinder (20) having a front end (22) and a back end (25); a piston (30) having a head (35), a connecting rod (38) and a knob (39), a gasket (40) having one or more holes, a cap (50) having a valve (60) closable by a top (65), a front handle (70) having a handle portion (75) and a veil-portion (76), a back-handle (80) having a handle-portion (85) and a veil-portion (86). A retaining ring (90) is shown as well as the O-ring (100) adjusting the inner cylinder (20) snugly into the outer cylinder (10). A second O-ring (110) is shown to adjust the head of the piston (35) snugly inside the inner cylinder (20). A seal (120) tightens the connection of the cap and the front end of the outer cylinder.

Figure 3:
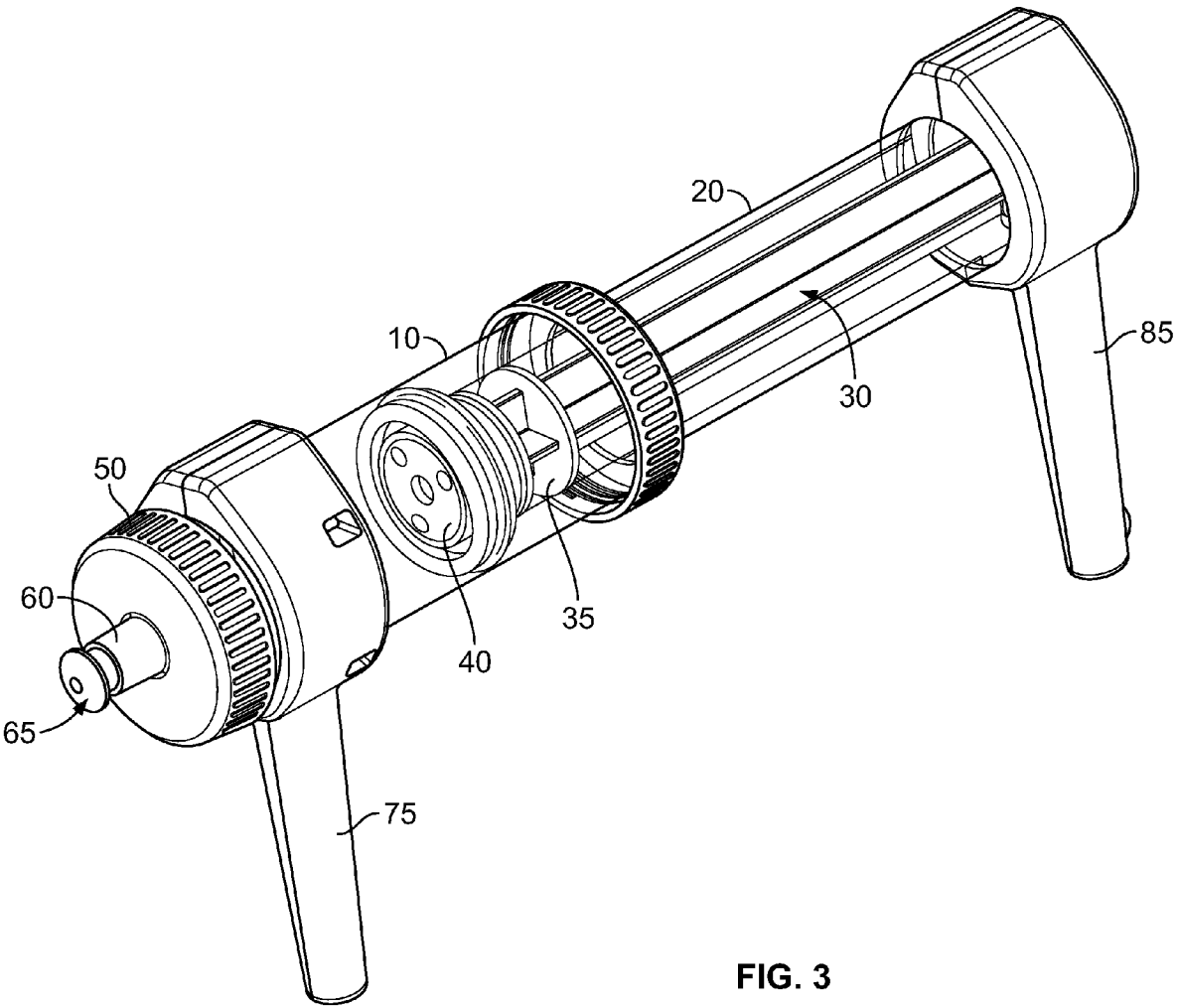
FIG. 3 shows a side view of the preferred embodiment in filling position.
Figure 4:
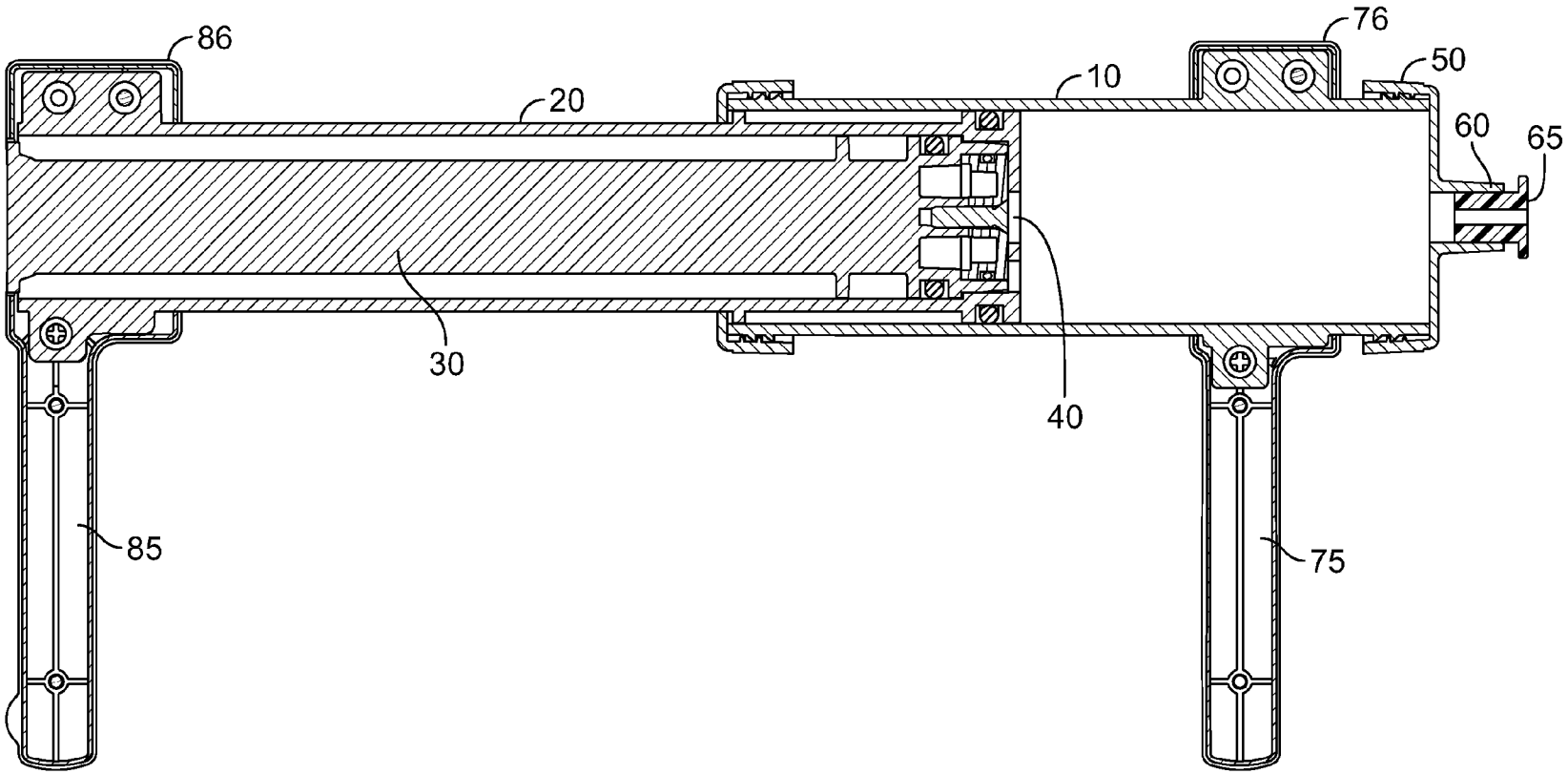
FIG. 4. shows a cross sectional view of the preferred embodiment in filling position.

FIGS. 3 and 4 showing the mixer in filling position. The inner cylinder (20) is pulled backwards by holding the front handle (75) and pulling the back handle (85) backwards, whereby the outer cylinder (10) forms a container capable of receiving the components to be mixed together. The gasket (40) forms the bottom of the container and the cap (50) forms the top of the container. In order to mix the components the user now pulls the piston (30) out from the inner cylinder (20). The components in the formed container can be initially mixed, when the cap (50) and the valve (60) are closed. The user now holds both the front handle (75) and back handle (85) and pushes the back handle toward the front handle. This forces the components through the holes in the gasket (40) and the components enter a container formed by the inner cylinder (20). The head of the piston (35) will now serve as a bottom of the container and the gasket (40) serves as the top of the container. A more complete mixing is achieved by holding the front (75) and back (85) handles and pulling the back handle backwards. The components are now forced again through the holes in the gasket (40) into the container formed by the outer cylinder (10) as the inner cylinder (20)

moves backward and the components are squeezed between the head of the piston (35) and the gasket (40). The user can repeat moving the inner cylinder (20) backwards and forwards until a complete mixing is achieved.

Figure 5:
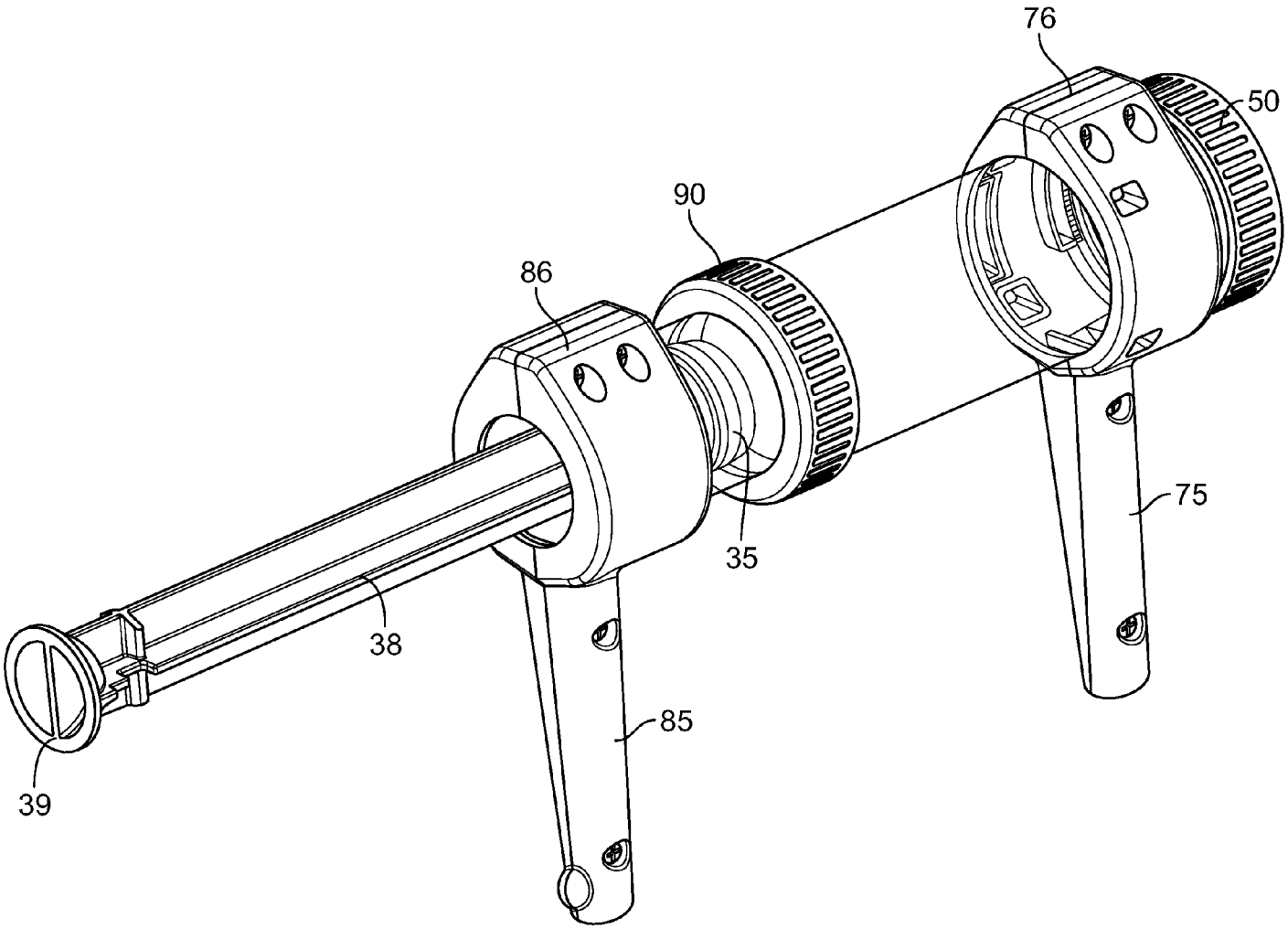
FIG. 5 shows a side view of the preferred embodiment in dispense position.
Figure 6:
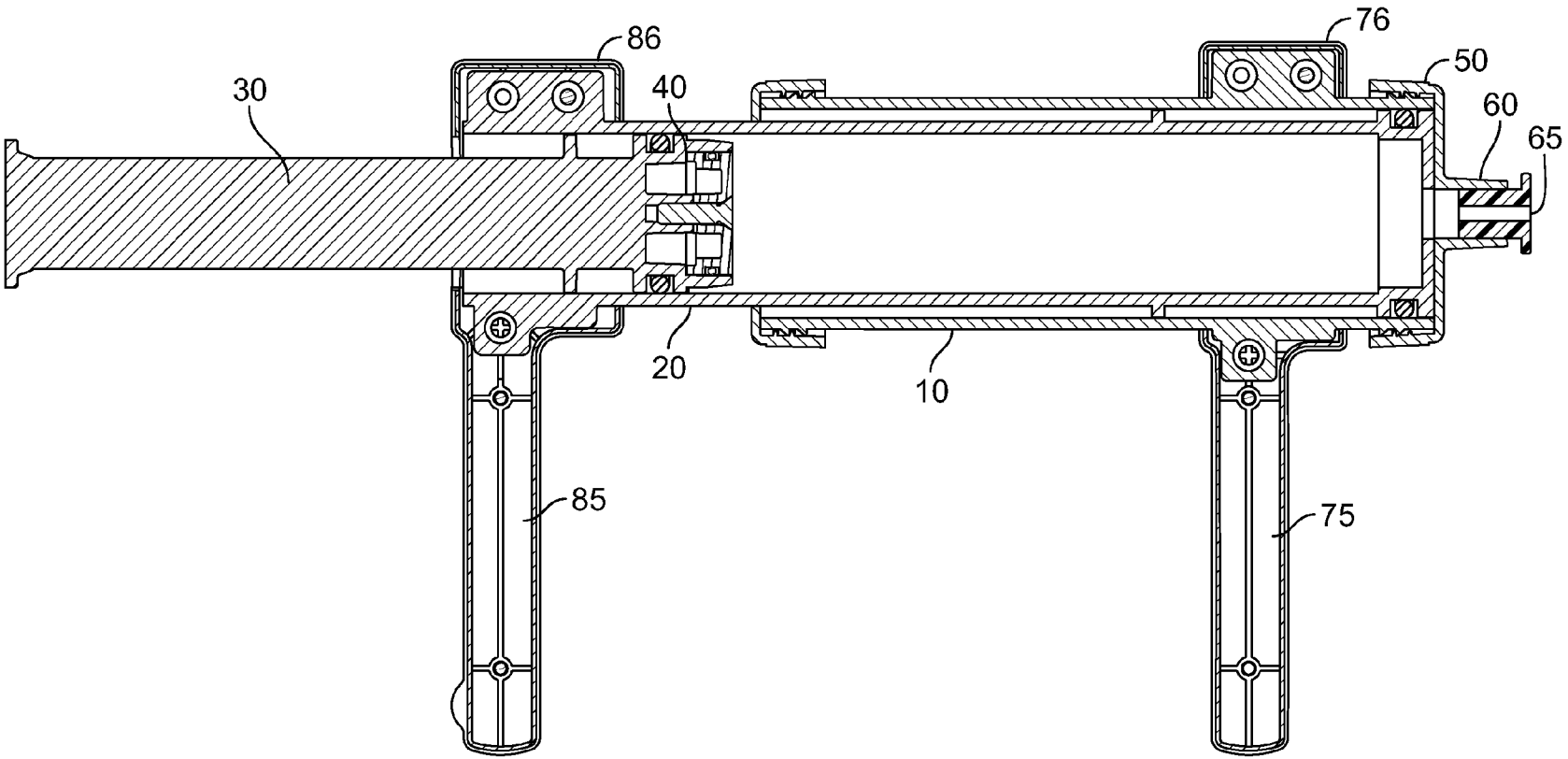
FIG. 6 shows a cross sectional view of the preferred embodiment in dispense position.

FIGS. 5 and 6 show the mixer in dispense position. Once the components are mixed thoroughly, the mixture may be dispensed through the valve (60). The user first holds the front (75) and back (85) handles and pushes the back handle toward the front handle, whereby the mixture moves from the container formed by the inner cylinder (10) through the holes in the gasket (40) into the container formed by the outer cylinder (10). The user then opens the valve (60) and pushes the piston (30) inside the inner cylinder (20) whereby the mixed components are forced through the holes in the gasket (40) and through the valve (60).

Figure 7B:
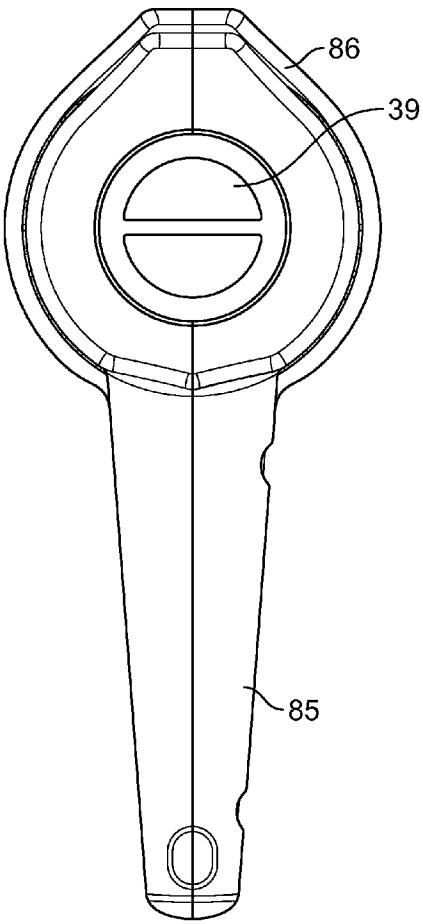
FIGS. 7A and B show a back view of the device. The knob is in open position in FIG. 7A and in close position in FIG. 7B.
Figure 7A:
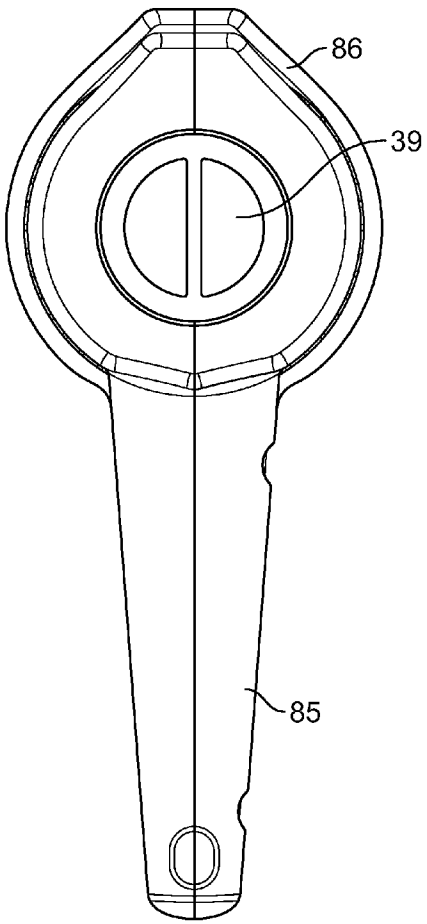

FIG. 7 shows the device from back view. The knob of the piston has position to be locked, whereby the user cannot pull the piston out from the inner cylinder (20) and a position to be open when the piston can be pulled out.

Figure 8:
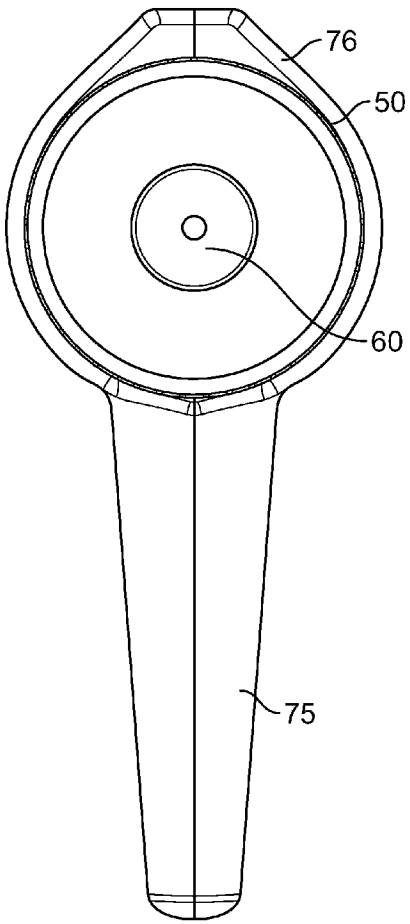
FIG. 8 shows a front view of the device.

FIG. 8 shows the device from front view. The cap (50) has a valve (60) that can be closed with a top. The top may be a sport-top, similar as in bottles used for sports-drinks, where the top is open when pulled out and closed when pushed in. Any other kind of tops is also included into the invention.

According to a preferred embodiment the length measured from the front end (12) of the outer cylinder (10) to the back end (25) of the inner cylinder (20) is between 10 and 14 inches, when the inner cylinder is pulled all the way out from the outer cylinder. The distance between the front handle (75) and back handle (85) in this position is preferably 9-12 inches. When the inner cylinder (20) is pushed all the way into the outer cylinder (10), the handles are preferably 6 to 8 inches apart from each other. The diameter of the outer cylinder (20) is preferably between 2 and 3 inches and the diameter of the inner cylinder (10) is preferably between 1.5 and 2 inches. Most preferably the diameter of the inner cylinder (10) is about 1.9 inches and the diameter of the outer cylinder (20) is about 2.3 inches. According to a most preferred embodiment the diameter of the inner cylinder (10) narrows slightly from the front end toward the back end, thereby enabling maximal dispense of the dye when the mixer is in dispense position, because the O-ring (110) will squeeze tighter against the inner cylinder in the front of the cylinder. The diameter of the inner cylinder is optimally a few millimeters narrower from the front end than from the back end. This narrowing feature of the inner cylinder is important in that it enables thorough cleaning of the mixer after mixing of the color.

The device of this invention may be made of plastic. According to a preferred embodiment the cylinders are transparent plastic so that the user can see when the components are fully mixed. According to the most preferred embodiment the cylinders are made of polycarbonate.

According to one preferred embodiment there is a scale molded on the outer cylinder to enable accurate measurement of the components.

According to one preferred embodiment the mixed dye is dispensed in a bowl for further application onto the hair. According to an alternative embodiment an applicator may be attached on the cap to apply the dye directly onto the hair. According to still another embodiment the cap may be replaced with an applicator to apply the dye onto the hair.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A universal mixer comprising an outer cylinder having a front end and a back end, said front fitting to a detachable cap having a valve, and said back fitting detachably to a retainer ring;

an inner cylinder being telescopically nested into the outer cylinder;

said inner cylinder having a front end and a back end;

said front end being sealed with a gasket having one or more holes, and said inner cylinder snugly fitting in the outer cylinder;

a piston inserted inside the inner cylinder, said piston comprising a head, a connecting rod and a knob, said head snugly fitting into the inner cylinder, said connecting rod connecting the head and the knob, and the knob enabling moving the connecting rod inward and outward;

a front handle comprising a handle-piece and a veil-piece, said veil-piece surrounding the front end of the outer cylinder;

a back handle comprising a handle-piece and a veil-piece, said veil-piece surrounding the back end of the inner cylinder;

the outer cylinder being capable of receiving components to be mixed together through the opened cap when the inner cylinder is pulled backwards by holding the front handle and pulling the back handle backwards;

the mixer being capable of initially mixing the components when the cap is closed and a user is holding the front handle and pushing the back handle toward forward, whereby the components enter into the inner cylinder through the holes in the gasket while the inner cylinder moves forward inside the outer cylinder; and the mixer being capable of further mixing the components when the user holds the front handle and pulls the back handle backward, whereby the inner cylinder moves backward and the piston stays in place causing the components to squeeze between the gasket and the head of the piston and thereby enter through the holes in the gasket into the outer cylinder.

2. The mixer of claim 1, wherein the inner cylinder has a diameter that slightly increases from the front end toward the back end.

3. The mixer of claim 2, wherein the front end of the outer cylinder is grooved to fit into the cap and the back end of the first cylinder is grooved to fit to the retainer ring.

4. The mixer of claim 2, wherein the inner cylinder is adjusted to snugly fit in the outer cylinder with an O-ring surrounding the front end of the inner cylinder, and the head of the piston is adjusted to snugly fit in the inner cylinder with an O-ring surrounding the head of the piston.

5. The mixer of claim 1, wherein the components are hair dye and developer.

6. The mixer of claim 1, wherein the outer cylinder is transparent and measuring units are marked on the cylinder to enable accurate measuring of the components to be mixed.

7. The mixer of claim 1, wherein the mixer is made of hard plastic.

8. The mixer of claim 1, wherein the inner and outer cylinders are made of poly carbonate.

9. The mixer of claim 1, wherein the outer cylinder has a diameter of 2.3 inches and the inner cylinder has a diameter of 1.9 inches.

10. A method to mix two or more components, said method comprising the steps of:

a) providing a mixer comprising an outer cylinder having a front end and a back end, said front end being grooved to fit to a detachable cap having a valve, and said back end being grooved to fit detachably to a retainer ring;

an inner cylinder being telescopically nested into the outer cylinder;

said inner cylinder having a front end and a back end;

said front end being sealed with a gasket having one or more holes, and said inner cylinder snugly fitting in the outer cylinder;

a piston inserted inside the inner cylinder, said piston comprising a head, a connecting rod and a knob, said head snugly fitting into the inner cylinder, said connecting rod connecting the head and the knob, and the knob enabling moving the connecting rod inward and outward;

a front handle comprising a handle-piece and a veil-piece, said veil-piece surrounding the front end of the outer cylinder;

a back handle comprising a handle-piece and a veil-piece, said veil-piece surrounding the back end of the inner cylinder;

b) opening the cap, pulling the inner cylinder backward by pulling the back handle backwards while holding the front handle, and pulling the piston out;

c) filling the components into a space formed by the outer cylinder and closing the cap and the valve;

d) forcing the components to move through the holes in the gasket into the inner cylinder by moving the inner cylinder forward by holding the front handle and pushing the back handle forward;

e) allowing further mixing of the components by forcing the components through the holes in the gasket into the outer cylinder by moving the inner cylinder backward by holding the front handle and pulling the back handle backwards;

f) repeating steps d and e) as many times as needed to get a complete mixing of the compounds and having step d) as the last step;

g) opening the valve and dispensing the completely mixed compounds through the valve by pushing the piston inside the inner cylinder.

11. The method of claim 10, wherein the components are hair color and developer.

12. The method of claim 10, wherein step a) includes a step of measuring the components on a scale printed on the outer cylinder.

13. A method to mix and dispense hair color, said method comprising the steps of:

a) providing a mixer comprising an outer cylinder having a front end and a back end, said front end being grooved to fit to a detachable cap having a valve, and said back end being grooved to fit detachably to a retainer ring;

an inner cylinder being telescopically nested into the outer cylinder;

said inner cylinder having a front end and a back end;

said front end being sealed with a gasket having one or more holes, and said inner cylinder snugly fitting in the outer cylinder;

a piston inserted inside the inner cylinder, said piston comprising a head, a connecting rod and a knob, said head snugly fitting into the inner cylinder, said connecting rod connecting the head and the knob, and the knob enabling moving the connecting rod inward and outward;

a front handle comprising a handle-piece and a veil-piece, said veil-piece surrounding the front end of the outer cylinder;

a back handle comprising a handle-piece and a veil-piece, said veil-piece surrounding the back end of the inner cylinder;

b) opening the cap, pulling the inner cylinder backward by pulling the back handle backwards while holding the front handle and pulling the piston out;

c) filling a hair dye and a developer into a space formed by the outer cylinder and closing the cap and the valve;

d) forcing the dye and developer to move through the holes in the gasket into the inner cylinder by moving the inner cylinder forward by holding the front handle and pushing the back handle forward;

e) allowing further mixing of the dye and the developer by forcing them through the holes in the gasket into the outer cylinder by moving the inner cylinder backward by holding the front handle and pulling the back handle backward;

f) repeating steps d and e) as many times as needed to get a complete mixing of the dye and the developer and having step d) as the last step;

g) opening the valve and dispensing the completely mixed dye and developer through the valve by pushing the piston inside the inner cylinder.

* * * * *